US006036626A

United States Patent [19]

Taylor

[11] Patent Number: 6,036,626

[45] Date of Patent: Mar. 14, 2000

[54] ADJUSTABLE RESISTANCE EXERCISE DEVICE

[76] Inventor: Brent N. Taylor, 461 W. 7th St., Erie, Pa. 16502

[21] Appl. No.: 09/175,692

[22] Filed: Oct. 20, 1998

[51] Int. Cl.[7] ..... A63B 22/00

[52] U.S. Cl. ..... 482/121; 482/121; 482/122

[58] Field of Search ..... 482/92, 110, 115, 482/121–126

[56] References Cited

U.S. PATENT DOCUMENTS

| | | | |
|---|---|---|---|
| 4,026,549 | 5/1977 | Gunn | 272/137 |
| 4,059,265 | 11/1977 | Wieder et al. | 272/137 |
| 4,540,173 | 9/1985 | Hopkins, Jr. | 272/139 |
| 4,588,186 | 5/1986 | Calabrese | 272/126 |
| 4,685,671 | 8/1987 | Hagerman et al. | 272/139 |
| 4,930,767 | 6/1990 | Hamm | 272/96 |
| 5,090,691 | 2/1992 | Pollock | 482/139 |
| 5,112,287 | 5/1992 | Brewer | 482/130 |
| 5,141,223 | 8/1992 | Block | 482/124 |
| 5,254,064 | 10/1993 | Rock | 482/126 |
| 5,476,431 | 12/1995 | Wilkinson et al. | 482/54 |
| 5,514,059 | 5/1996 | Romney | 482/124 |
| 5,695,437 | 12/1997 | Olschansky et al. | 482/125 |
| 5,743,838 | 4/1998 | Willis | 482/124 |
| 5,813,954 | 9/1998 | Wilkinson | 482/125 |

*Primary Examiner*—Glenn E. Richmon
*Attorney, Agent, or Firm*—Richard K. Thomson

[57] ABSTRACT

A continuous loop foot strap is connected to a bungee cord by an O-ring. An opposite end of the bungee cord is looped through a flexible handle and back through a clamping device. A push button actuator permits the size of the handle loop to be adjusted to adjust the overall length of the device to a) enable a different user to adjust the device for her/his needs, b) alter the configuration for use in a different exercise, or c) increase the resistance force afforded by the device as repetition of the various exercises results in strengthening of various muscle groups. Illustrative exercises are discussed.

7 Claims, 3 Drawing Sheets

ADJUSTABLE RESISTANCE EXERCISE DEVICE

The present invention is directed to an exercise device. More particularly, the present invention is directed to a highly portable piece of exercise equipment in which the resistance tension can be adjusted. The adjustment capabilities can be advantageously employed to provide different resistance for different users/exercises or to increase resistance as the user's strength improves.

BACKGROUND AND SUMMARY OF THE INVENTION

As a reaction to our overindulgent life styles, exercise programs, devices and equipment of all shapes and sizes have been developed and are available today. There are exotic exercycles, rowing machines, stair steppers, and treadmills that are both bulky and expensive.

In today's highly mobile culture, both personal and professional lifestyles involve frequent travel. The size of these large pieces of equipment make them impractical for carrying along. This leads to an interruption of the exercise regimen, frequently involves physical retrogression, necessitating a new start up routine. Because of the added hurdle that starting again involves and the loss of physical tone, such a break in the exercise regimen may become a permanent hiatus.

A number of more manageable devices have been offered that still are quite expensive. Even though these devices are of a lesser size, they may not readily travel with the user. This is a result of their rigidity and the limited amount of space in most traveler's luggage.

It is an object of this invention to provide an inexpensive exercise device that can easily be packed for travel. In addition, the exercise device of the present invention is highly flexible in its usage, capable of use with many different muscle groups and useful by many different persons. For example, the exercise device of the present invention can be used by a bedridden patient that is rehabilitating one or more limbs or muscle groups. The exercise device of the present invention provides adjustable resistance which further enhances its flexibility: the same device can be used by different members of the family; as a user strengthens a muscle group, s/he can adjust the resistance in order to challenge that muscle group to become even stronger. The exercise device of the present invention is marketed individually under the trademark BED-ER-SIZER muscle toning system. However, by purchasing a pair of devices, a user could simultaneously exercise both right and left arms, wrists, calves, ankles, or thighs. The name BED-ER-SIZER reflects the flexibility of the exercise system, being capable of use by rehab patients confined to their beds.

The difficulties associated with the prior art exercise devices are overcome and the objects of the present invention are accomplished by an adjustable resistance exercise device comprising: (a) a continuous loop of non-stretchable material, said loop designed to receive a wearer's foot; (b) ar elastomeric O-ring securing said continuous loop to an adjustable resistance exercise strap; (c) said adjustable resistance exercise strap comprising a bungee cord having a first length extending between a first end and a second end, said first end being doubled over said O-ring and fixed thereabout, said second end forming an adjustable loop; (d) a soft, flexible handle slipped onto said bungee cord in a region of said adjustable loop; (e) clamping means for engaging a point near said second end and another point along the length of said bungee cord intermediate said first and second ends, said clamping means having a first closed position in which said clamping means defines said adjustable loop and a second open position in which said clamping means can be moved along said bungee cord to adjust a length of said adjustable loop; whereby adjusting said length of said adjustable loop adjusts an overall length of said adjustable resistance strap which, in turn, adjusts the resistance of said adjustable resistance strap.

Various other features, advantages and characteristics of the present invention will become apparent to one of ordinary skill in the art after a reading of the following specification.

BRIEF DESCRIPTION OF THE DRAWINGS

The preferred embodiment(s) of the present invention is/are described in conjunction with the associated drawings in which like features are indicated with like reference numerals and, in which.

DETAILED DESCRIPTION OF PREFERRED EMBODIMENT(S)

Figure 1:
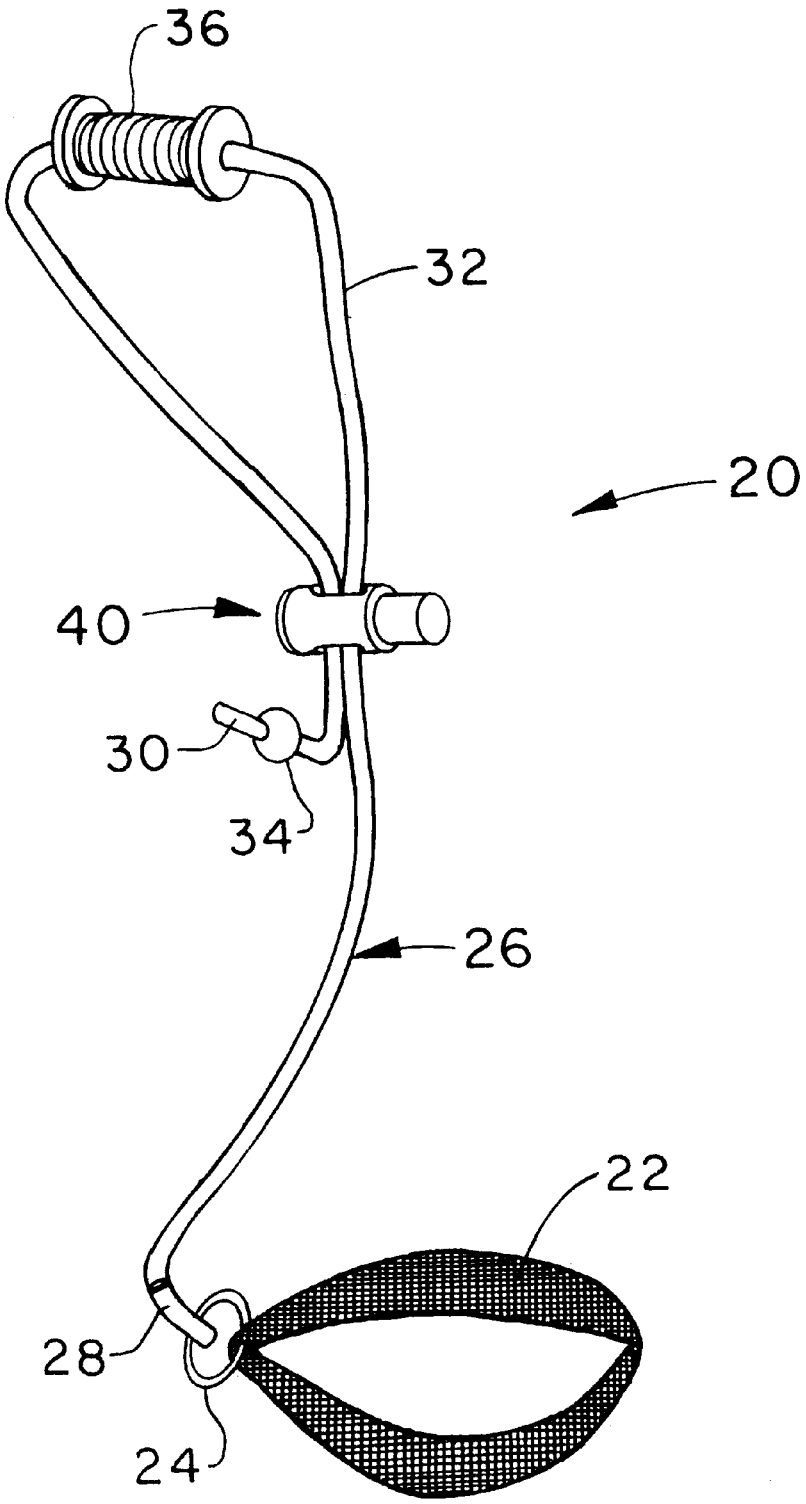
FIG. 1 is a front view of a first embodiment of the exercise device of the present invention.

A first preferred embodiment of the adjustable resistance exercise device of the present invention is depicted in FIG. 1 generally at 20. Exercise device 20 includes a non-elastic foot strap 22. Foot strap 22 is formed as a continuous loop of non-stretchable material which may be, for example, nylon cord fabric of the type used for straps on backpacks, and the like. While strap 22 has been labeled a foot strap, since in many of the prescribed exercises it will be surrounding a foot, it will be appreciated that strap 22 may be hooked over a post or around a table leg to provide the desired resistance for a particular muscle group.

An O-ring 24 is used to attach foot strap 22 to adjustable resistance cord 26. Strap 22, formed as a 10–12 inch length of strap, will be inserted through O-ring 24 and its ends stitched together to form an continuous loop. Cord 26 is preferably a bungee cord (i.e., a stretchable nylon fabric over a rubber, natural or synthetic, cord) generally five feet in length. The elastomeric cord in the bungee forming cord 26 may be of, for example, a diameter falling in the range between ¼" and ½", preferably ⅜". A system 20 having reduced resistance could be formed of smaller diameter cord and of significantly greater resistance from the ½" cord. First end 28 of cord 26 is doubled around O-ring 24 and fastened by a secure connector forming an eyelet that receives O-ring 24. This connector can take the form of stitching, plastic or metal bands wrapped around the two strands, or a metal clasp that is crimped around the two thicknesses of the doubled bungee to secure the connection. Second end 30 is inserted through clamping device 40, through soft, flexible handle 36 and then back through clamping device 40 to make an adjustable loop 32. A ball 34 can then be swaged on the end 30 of cord 26 to prevent removal from the clamping device 40. Flexible handle 36 is preferably made of a cellular foam or sponge rubber and prevents the cord 26 from cutting into the user's hand.

By changing the size of the adjustable loop 32 the effective length of device 20 can be altered. Handle 36 slides easily relative to cord 26 in order to facilitate the change in the size of loop 32. The length can be changed to accommodate different sized users, different exercises or to increase the resistance as repeated exercise results in strengthening of various muscle groups. If the clamping device 40 is positioned to render the loop 32 too small for the size and strength of the person using the system 20, the clamping device 40 slides along the cord 26 to a more appropriate location. The system is, in a sense, self-correcting preventing the user from over-tensioning the cord 26.

Figure 2A:
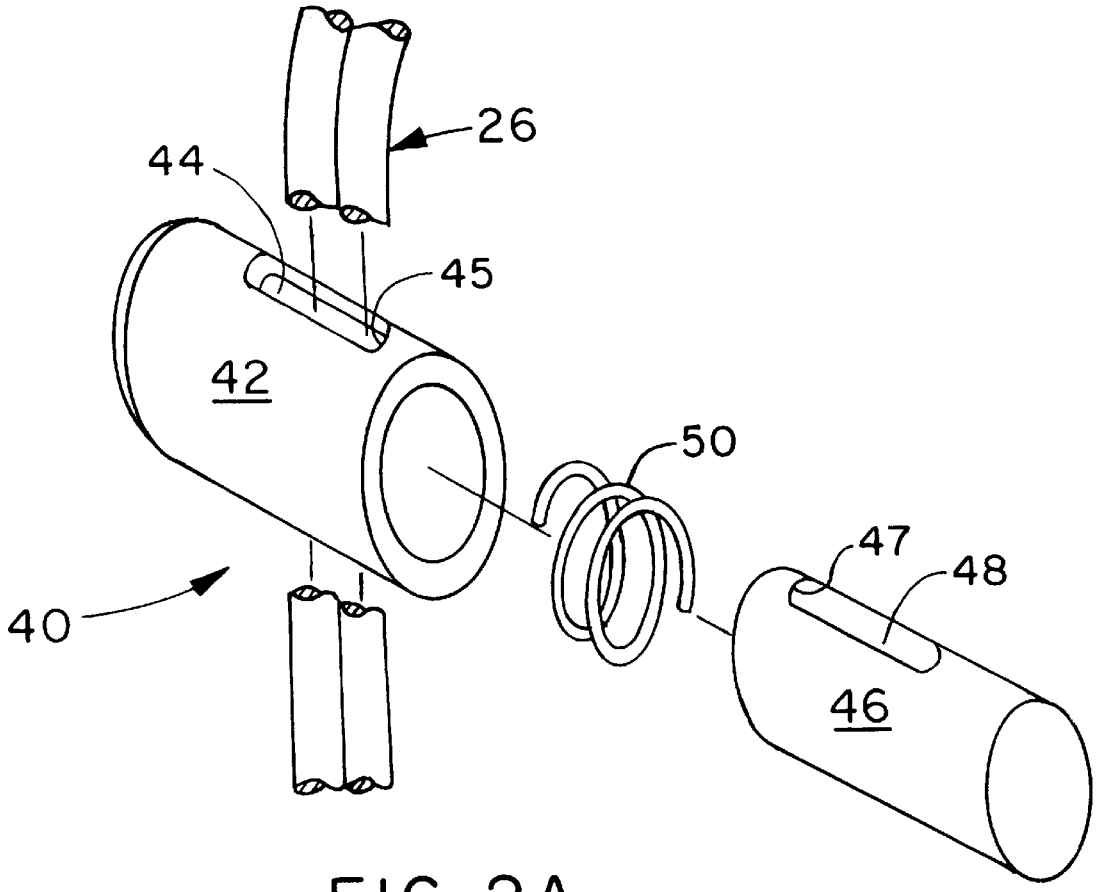
FIG. 2A is an exploded view of the clamping mechanism shown in FIG. 1.
Figure 2B:
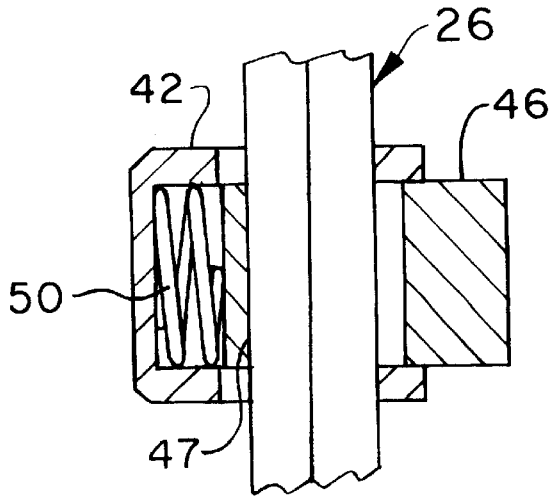
FIG. 2B is an enlarged view of the clamping mechanism used in the first embodiment.

The features of clamping device 40 are shown in greater detail in FIGS. 2A and 2B. Clamping device 40 includes a first cylindrical element 42. Cylindrical element 42 is hollow and has a slot 44 extending laterally there through. Second cylindrical element 46 is a solid member with a slot 48 extending laterally there through. Coil spring 50 biases cylindrical element 46 out of cylindrical element 42 to a clamping position. The upper end 45 of slot 44 and the lower end 47 of slot 48 clasp the two passes of bungee cord 26 preventing movement thereof and thereby defining the size of loop 32. By compressing second cylindrical element 46 against spring 50, slots 44 and 48 are brought into alignment and cord 26 can pass freely through the aligned slots to adjust the size of loop 32 and the overall length of the device 20. Cylindrical element 46 functions as a push button actuator for clamping mechanism 40. By compressing actuator 46 against spring 50, it is moved to an unclamped position permitting adjustment of the size of loop 32. Although FIGS. 2A and 2B indicate that elements 42 and 46 employ slots 44 and 48 for clamping, the preferred configuration has become a pair of lateral holes each slightly larger than the diameter of the cord 26 formed in each cylindrical element with each hole receiving one strand of cord 26. Spring 50 displaces cylinder 46 relative to cylinder 42 to effect clamping in the manner previously described.

Figure 3A:
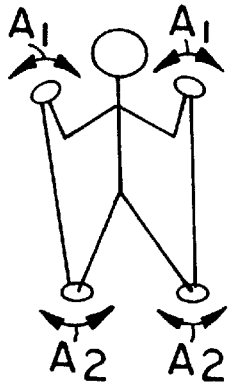
FIG. 3A is a schematic depiction of a first and a second exercise which can be performed with the adjustable resistance exercise device of the present invention.
Figure 3B:
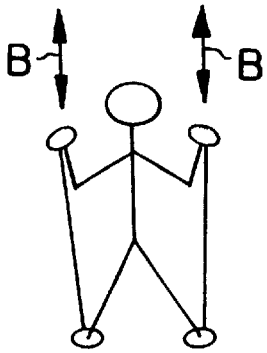
FIG. 3B is a schematic depiction of a third exercise.
Figure 3C:
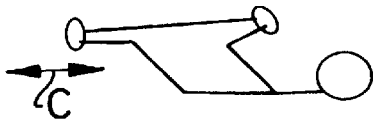
FIG. 3C is a schematic depiction of a fourth exercise.

Variable resistance exercise device 20 is capable of providing resistance for a number of different muscle groups. Examples of exercises that can be done are shown in FIGS. 3A–3G. Although the stick figure shown in FIGS. 3A, 3B, 3F, and 3G appear to be standing, it will be understood these exercises can be achieved while laying in bed and that this depiction is for ease of illustration. Further, with a single BED-ER-SIZER, left and right arm and leg muscle groups can be sequentially manipulated. With two of the devices, simultaneous exercise would be possible. A shown in FIG. 3A, by catching foot strap 22 with the right or left foot, right or left bisceps can be exercised by simple arm curls as indicated by arrows A,. In the prone position, thigh muscles could be exercised by moving left or right foot in the direction of arrows A. From the same position, the shoulder muscles can be exercised by vertically extending the hands as portrayed by arrows B (FIG. 3B). FIG. 3C depicts exercising leg muscles by moving foot straps 24 in alternate directions along arrows C.

Figure 3D:
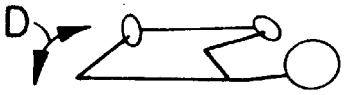
FIG. 3D is a schematic depiction of a fifth exercise.
Figure 3E:
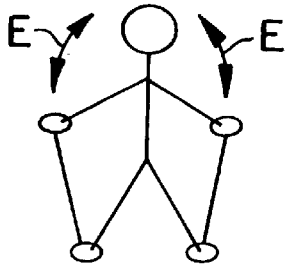
FIG. 3E is a schematic depiction of a sixth exercise.
Figure 3F:
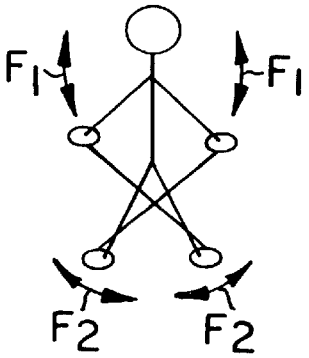
FIG. 3F is a schematic depiction of a seventh and an eighth exercise.
Figure 3G:
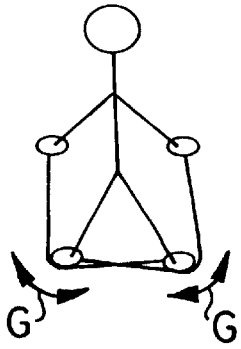
FIG. 3G is a schematic depiction of a ninth exercise.

FIG. 3D schematically depicts laying on ones stomach and as the lower leg is rotated about a knee pivot point, the feet pulling against the resistance afforded by cord 26, the upper thigh muscles will be exercised. FIG. 3E shows yet a fourth exercise which can be performed from the FIGS. 3A, 3B position (upright or horizontal). The exercise depicted there is for the arms to be rotated at the shoulder, elbows locked, in order to work the shoulder muscles. FIG. 3F suggests crossing foot strap 22 to the opposite foot with respect to the hand engaging handle 36 in order to increase the resistance for the shoulder movement indicated by arrows $F_1$; this will also alter the particular muscles that are being exercised. Also, when in the prone position, the cross-over engagement can permit exercise of the inner thigh muscles as feet are moved inward and outward per arrows $F_2$. FIG. 3G shows an alternate foot engagement for foot straps 22 similar to that shown in FIG. 3F only cord 26 is passed over the sole of the same side foot. The movement of foot straps 22 inward and outward along arrows G will provide exercise for the inner thigh muscles which is more directly opposing the movement and therefore, an increase in the magnitude of the force.

It will be appreciated that these exercises are merely exemplary of those which can be performed and it is contemplated that many other exercises can be performed to challenge other muscle groups. For example, cross handing the cords 26 across the back, squatting, then standing can provide additional exercises for the upper thigh muscles. By moving the contact point for these cross handed cords 26 up the back and bending at the waist, exercises can be performed to tighter stomach muscles. Virtually any muscle group can be exercised, and due to the flexibility of the device 20, these exercises can easily be done in a bed as part of a rehabilitation program where exercises with other equipment might not be feasible because they require the patient to stand. It will be further appreciated that exercise device 20 easily packs into a traveller's luggage and permits a continuation of an exercise regimen while on a business or vacation trip.

Various changes, alternatives and modifications will become apparent to one of ordinary skill in the art following a reading of the foregoing specification. It is intended that any such changes, alternatives and modifications as fall within the scope of the appended claims be considered part of the present invention.

I claim:

1. An adjustable resistance exercise device comprising:

(a) a continuous loop of non-stretchable material, said loop designed to receive a wearer's foot;

(b) an adjustable resistance exercise strap comprising a bungee cord having a length extending between a first end and a second end, said second end forming an adjustable loop;

(c) means for securing said continuous loop to said adjustable resistance exercise strap, said means for securing connecting said continuous loop and said first end of said bungee cord;

(d) a soft, flexible handle slipped onto said bungee cord in a region of said adjustable loop;

(e) clamping means for engaging said bungee cord near said second end and another point along the length of said bungee cord intermediate said first and second ends, said clamping means having a first engaged position in which said clamping means defines said adjustable loop and a second disengaged position in which said clamping means can be moved along said bungee cord to adjust a length of said adjustable loop;

whereby adjusting said length of said adjustable loop adjusts an overall length of said adjustable resistance strap for a particular user and exercise.

2. The exercise device of claim 1 wherein said clamping means further comprises a mechanism with a push button actuator, said push button actuator including a biasing spring urging said actuator to a clamping position, said actuator being compressible against a force of said biasing spring to an unclamped position whereby said clamping means is movable to another position along said adjustable resistance strap.

3. The exercise device of claim 1 wherein said second end includes a tip with a ball swaged thereon to prevent said second end being removed from said clamping device.

4. The exercise device of claim 1 wherein said soft flexible handle slides easily relative to said bungee cord.

5. The exercise device of claim 1 wherein said continuous loop of non-stretchable material comprises a band of nylon cord fabric of the type used for backpack straps.

6. The exercise device of claim 1 wherein said clamping device can be adjusted to substantially include an entire length of said bungee cord in said adjustable loop thereby to converting said exercise device into a second apparatus having twice the resistance as said first exercise device.

7. The adjustable resistance exercise device of claim 1 wherein said means for securing said continuous loop to said first end of said adjustable resistance exercise strap comprises an elastomeric O-ring, said continuous loop and said first end of said adjustable resistance exercise strap being threaded through and attached to said elastomeric O-ring.

* * * * *